US010166767B2

(12) United States Patent
Akiyama

(10) Patent No.: US 10,166,767 B2
(45) Date of Patent: Jan. 1, 2019

(54) DRIVE WAVEFORM GENERATING DEVICE, LIQUID DISCHARGE DEVICE, AND LIQUID DISCHARGE APPARATUS

(71) Applicant: Ricoh Company, Ltd., Ohta-ku, Tokyo (JP)

(72) Inventor: Kohta Akiyama, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/584,078

(22) Filed: May 2, 2017

(65) Prior Publication Data

US 2017/0326874 A1 Nov. 16, 2017

(30) Foreign Application Priority Data

May 11, 2016 (JP) ..... 2016-095412
Mar. 24, 2017 (JP) ..... 2017-059326

(51) Int. Cl.
*B41J 2/045* (2006.01)

(52) U.S. Cl.
CPC ..... *B41J 2/04588* (2013.01); *B41J 2/04541* (2013.01); *B41J 2/04581* (2013.01); *B41J 2/04593* (2013.01)

(58) Field of Classification Search
CPC ..... B41J 2/04525
See application file for complete search history.

(56) References Cited

FOREIGN PATENT DOCUMENTS

| | | | | |
|---|---|---|---|---|
| JP | 60-008075 | | 1/1985 | |
| JP | 62116154 A | * | 5/1987 | ..... B41J 3/04 |
| JP | 2-164545 | | 6/1990 | |

* cited by examiner

*Primary Examiner* — Julian D Huffman
(74) *Attorney, Agent, or Firm* — Harness, Dickey & Pierce, P.L.C.

(57) ABSTRACT

A drive waveform generating device includes a plurality of waveform generating units each configured to generate and output a drive waveform to a corresponding one of a plurality of pressure generators that are provided corresponding to a plurality of nozzles of a liquid discharge head. Each of the plurality of waveform generating units includes a detector and a waveform generator. The detector is configured to detect data associated with a type of the drive waveform to be applied to at least one pressure generator of the plurality of pressure generators corresponding to at least one adjacent nozzle to a target nozzle. The waveform generator is configured to change a waveform shape of the drive waveform to be applied to one pressure generator of the plurality of pressure generators corresponding to the target nozzle in accordance with the data detected by the detector.

15 Claims, 10 Drawing Sheets

FIG. 10

| | | | TYPE OF DROPLET DISCHARGED FROM TARGET NOZZLE | |
|---|---|---|---|---|
| | LEFT NOZZLE | RIGHT NOZZLE | SMALL DROPLET | LARGE DROPLET |
| TYPE OF DROPLET DISCHARGED FROM ADJACENT NOZZLE | NO DISCHARGE | NO DISCHARGE | 0 | 0 |
| | | SMALL DROPLET | −2 | 4 |
| | | LARGE DROPLET | 3 | −1 |
| | SMALL DROPLET | NO DISCHARGE | −2 | 4 |
| | | SMALL DROPLET | −4 | 7 |
| | | LARGE DROPLET | 1 | 2 |
| | LARGE DROPLET | NO DISCHARGE | 3 | −1 |
| | | SMALL DROPLET | 1 | 2 |
| | | LARGE DROPLET | 5 | −2 |

CELL VALUE REPRESENTS VOLTAGE ADJUSTMENT VALUE [%]

FIG. 11

| NOZZLE | 104 -1 | 104 -2 | 104 -3 | 104 -4 | 104 -5 | 104 -6 | 104 -7 | 104 -8 |
|---|---|---|---|---|---|---|---|---|
| DROPLET TYPE | LARGE DROPLET | SMALL DROPLET | NO DISCHARGE | NO DISCHARGE | SMALL DROPLET | LARGE DROPLET | LARGE DROPLET | SMALL DROPLET |
| CORRECTION VALUE | 4 | 3 | 0 | 0 | 3 | 2 | 2 | 3 |

DRIVE WAVEFORM GENERATING DEVICE, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2016-095412, filed on May 11, 2016, and 2017-059326, filed on Mar. 24, 2017, in the Japan Patent Office, the entire disclosure of each of which is hereby incorporated by reference herein.

BACKGROUND

Technical Field

Aspects of the present disclosure relate to a drive waveform generating device, a liquid discharge device, and a liquid discharge apparatus.

Related Art

In liquid discharge heads, adjacent crosstalk may occur in which the discharge speed of liquid from a target nozzle varies depending on discharge conditions of adjacent nozzles of the target nozzle. Such adjacent crosstalk is likely to occur with an increase in density of nozzles of a liquid discharge head, thus causing a deviation in landing position of the discharged droplet.

SUMMARY

In an aspect of the present disclosure, there is provided a drive waveform generating device that includes a plurality of waveform generating units each configured to generate and output a drive waveform to a corresponding one of a plurality of pressure generators that are provided corresponding to a plurality of nozzles of a liquid discharge head. Each of the plurality of waveform generating units includes a detector and a waveform generator. The detector is configured to detect data associated with a type of the drive waveform to be applied to at least one pressure generator of the plurality of pressure generators corresponding to at least one adjacent nozzle to a target nozzle. The waveform generator is configured to change a waveform shape of the drive waveform to be applied to one pressure generator of the plurality of pressure generators corresponding to the target nozzle in accordance with the data detected by the detector.

In another aspect of the present disclosure, there is provided a liquid discharge device that includes the liquid discharge head and the drive waveform generating device to generate and output the drive waveform to discharge liquid from the liquid discharge head.

In still another aspect of the present disclosure, there is provided a liquid discharge apparatus that includes the liquid discharge device.

In still yet another aspect of the present disclosure, there is provided a liquid discharge apparatus that includes the drive waveform generating device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 10 is a table of correction values used for generating a drive waveform according to a first embodiment of the present disclosure; and FIG. 11 is a table of examples of corrections of the discharging drive waveforms for respective nozzles used in the correction value table of FIG. 10.

Figure 1:
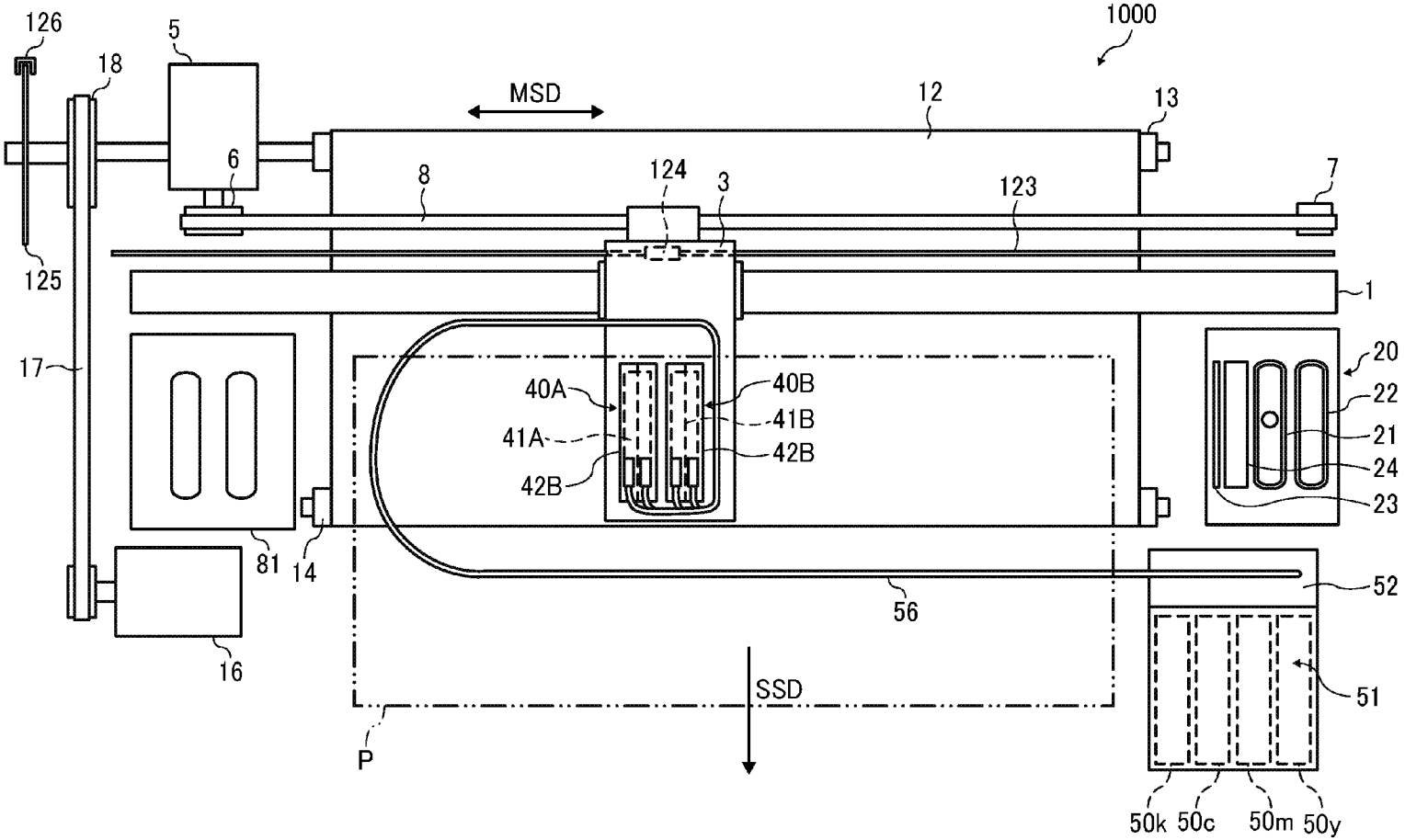
FIG. 1 is a plan view of a mechanical section of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2:
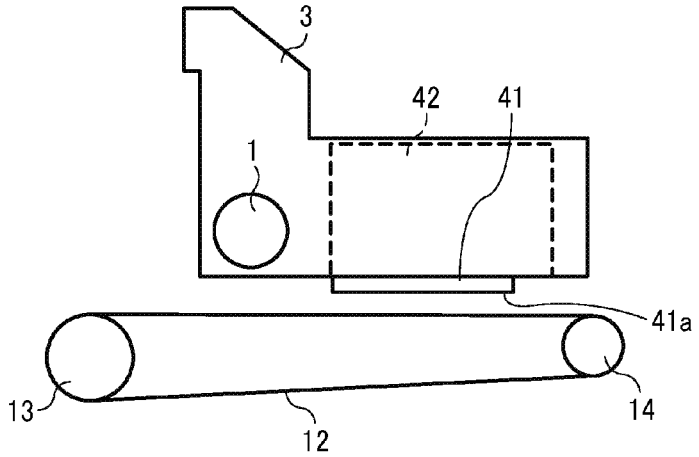
FIG. 2 is a side view of a portion of the mechanical section of FIG. 1.

Referring now to the drawings, wherein like reference numerals designate identical or corresponding parts throughout the several views, embodiments of the present disclosure are described below. First, a liquid discharge apparatus according to an embodiment of this disclosure is described with reference to FIGS. 1 and 2. FIG. 1 is a plan view of a mechanical section of the liquid discharge apparatus according to the present embodiment. FIG. 2 is a side view of a portion of the liquid discharge apparatus of FIG. 1.

A liquid discharge apparatus 1000 according to the present embodiment is a serial-type liquid discharge apparatus and includes a guide assembly, such as a main guide 1, to movably support a carriage 3 in a main scanning direction indicated by arrow MSD in FIG. 1. A main scanning motor 5 constituting part of a main scan moving unit reciprocally moves the carriage 3 in the main scanning direction MSD (a carriage movement direction) via a timing belt 8 laterally bridged between a drive pulley 6 and a driven pulley 7.

Two liquid discharge units 40A and 40B (collectively referred to as liquid discharge units 40 unless distinguished, which is the same in the following other members) are mounted on the carriage 3. Each of the liquid discharge units 40 is an integral unit of a liquid discharge head 41 as a liquid discharger and a head driver (drive waveform generating device) 509 (see FIG. 5).

Each liquid discharge head 41 includes two nozzle rows in each of which a plurality of nozzles are aligned. For example, one nozzle row of the liquid discharge head 41A of the liquid discharge unit 40A discharges droplets of black (K) and the other nozzle row discharges droplets of cyan (C). One nozzle row of the liquid discharge head 41B of the liquid discharge unit 40B discharges droplets of magenta (M) and the other nozzle row discharges droplets of yellow (Y).

In some embodiments, as the liquid discharge device, a single liquid discharge head may be used that has a nozzle face in which multiple nozzle rows, each including multiple nozzles arrayed in a row, are arrayed to discharge droplets of respective colors.

Each of the head tank 42A and the head tank 42B includes paired tank portions corresponding to the two nozzle rows of each of the liquid discharge heads 41A and 41B.

A cartridge holder 51 is disposed at an apparatus body of the liquid discharge apparatus 1000. Main tanks (liquid cartridges) 50 (50*y*, 50*m*, 50*c*, and 50*k*) to contain liquid of the respective colors are removably mounted to the cartridge holder 51.

The cartridge holder 51 includes a liquid feed pump unit 52 to supply liquid of the respective colors from the main tanks 50 to the tank portions of the head tanks 42A and 42B via supply tubes (also referred to as liquid supply passages) 56 for the respective colors.

To convey a sheet material 10, the liquid discharge apparatus 1000 also includes a conveyance belt 12 as a conveyor to attract the sheet material 10 and convey the sheet material 10 to a position opposing the liquid discharge heads 41 of the liquid discharge units 40. The attraction of the sheet material 10 with the conveyance belt 12 is performed by electrostatic attraction or air attraction.

The conveyance belt 12 is an endless belt and is stretched between a conveyance roller 13 and a tension roller 14. The conveyance roller 13 is rotated by a sub-scanning motor 16 via a timing belt 17 and a timing pulley 18, so that the conveyance belt 12 circulates in a sub-scanning direction indicated by arrow SSD in FIG. 1.

On one side in the main scanning direction MSD of the carriage 3, a maintenance device 20 to maintain and recover the liquid discharge heads 41 is disposed at a lateral side of the conveyance belt 12. On the other side in the main scanning direction MSD of the carriage 3, a first dummy ejection receptacle 81 to receive preliminarily-discharged liquid (dummy discharged liquid) from the liquid discharge heads 41 is disposed at another lateral side of the conveyance belt 12.

The maintenance device 20 includes, for example, a suction cap 21 and a moisture-retention cap 22 to cap the nozzle faces 41*a* of the liquid discharge heads 41, a wiper 23 to wipe the nozzle faces 41*a*, and a second dummy discharge receptacle 24 to receive liquid discharged by dummy discharge. Note that, in some embodiments, by the dummy discharge, liquid may be discharged into the suction cap 21.

An encoder scale 123 with a predetermined pattern is laterally bridged along the main scanning direction MSD between side plates. An encoder sensor 124 being a transmissive photosensor to read a pattern of the encoder scale 123 is mounted on the carriage 3. The encoder scale 123 and the encoder sensor 124 constitute a linear encoder (main scanning encoder) to detect the movement of the carriage 3.

A code wheel 125 is mounted on a shaft of the conveyance roller 13. An encoder sensor 126 being a transmissive photosensor is disposed to detect a pattern of the code wheel 125. The code wheel 125 and the encoder sensor 126 constitute a rotary encoder (sub-scanning encoder) to detect the movement amount and position of the conveyance belt 12.

In the liquid discharge apparatus 1000 thus configured, the sheet material 10 is fed and attracted onto the conveyance belt 12. With the sheet material 10 attracted on the conveyance belt 12, the conveyance belt 12 is circulated to convey the sheet material 10 in the sub-scanning direction SSD.

By driving the liquid discharge heads 41 in accordance with image signals while moving the carriage 3, liquid is discharged onto the sheet material 10, which is stopped below the liquid discharge heads 41, to form one line of a desired image. Then, the sheet material 10 is fed by a predetermined distance to prepare for the next operation to record another line of the image.

On receipt of a recording end signal or a signal indicating that a trailing end of the sheet material 10 has arrived at a recording area, the liquid discharge apparatus 1000 terminates the print operation and ejects the sheet material 10 to a sheet ejection tray.

Figure 3:
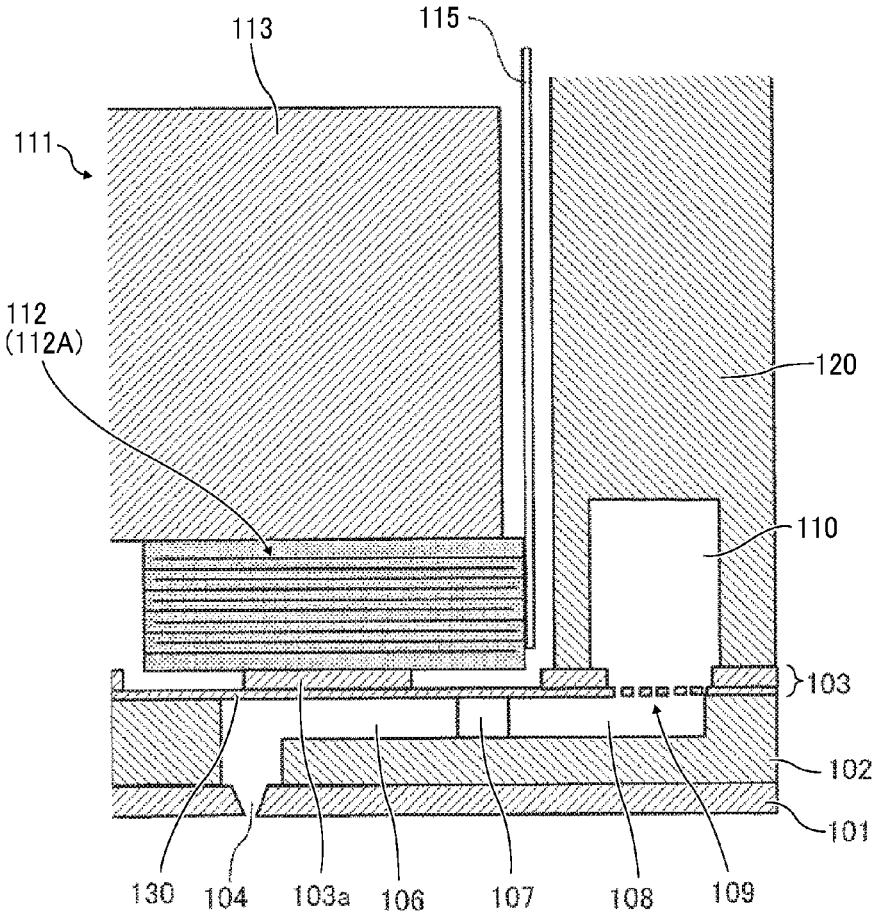
FIG. 3 is a cross-sectional view of a liquid discharge head in a direction (longitudinal direction of an individual liquid chamber) perpendicular to a nozzle array direction in which nozzles are arrayed in row.
Figure 4:
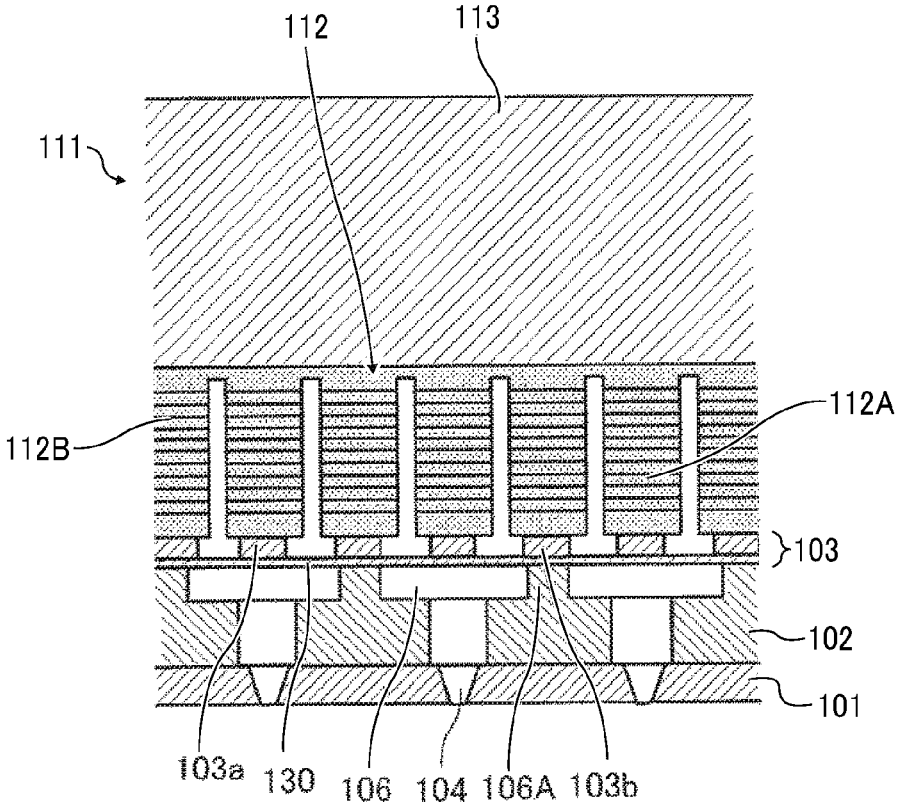
FIG. 4 is a cross-sectional view of the liquid discharge head of FIG. 3 cut along the nozzle array direction (the transverse direction of the individual liquid chamber)

A liquid discharge head according to an embodiment of the present disclosure is described with reference to FIGS. 3 and 4. FIG. 3 is a cross sectional view of the liquid discharge head in the direction (the longitudinal direction of the individual liquid chamber) perpendicular to the nozzle array direction. FIG. 4 is a cross sectional view of the liquid discharge head in the nozzle array direction (the transverse direction of the individual liquid chamber).

In the liquid discharge head 41, a nozzle plate 101, a channel plate 102, and a diaphragm member 103 are bonded together. Also, the head includes a piezoelectric actuator 111 to displace the diaphragm member 103 and a frame member 120 as a common channel member.

Thus, the liquid discharge head 41 includes individual liquid chambers (also referred to as pressure chambers or pressurizing chambers) 106 communicated with a plurality of nozzles 104 to discharge droplets, liquid supply passages 107 (also serving as fluid restrictors) to supply liquid to the individual liquid chambers 106, and liquid introduction portions 108 communicated with the liquid supply passages 107. Adjacent ones of the individual liquid chambers 106 are separated with a partition 106A.

Liquid is introduced from a common liquid chamber 110 as the common channel of the frame member 120 into each of the plurality of individual liquid chambers 106 via the liquid introduction portion 108 and the liquid supply passage 107 through a filter portion 109 formed in the diaphragm member 103.

The piezoelectric actuator 111 is disposed opposite the individual liquid chambers 106 with a deformable vibration portion 130 interposed between the piezoelectric actuator 111 and the individual liquid chamber 106. The vibration portion 130 constitutes part of a wall of the individual liquid chamber 106 of the diaphragm member 103.

The piezoelectric actuator 111 includes a plurality of laminated piezoelectric members 112 bonded on a base 113. The piezoelectric member 112 is groove-processed by half cut dicing. Pillar-shaped piezoelectric elements (piezoelectric pillars) 112A and support pillars 112B are disposed at predetermined distances in a comb shape.

The piezoelectric elements 112A are bonded to island-shaped projections 103*a* in the vibration portions 130 of the diaphragm member 103. The support pillars 112B are bonded to projections 103*b* of the diaphragm member 103.

The piezoelectric member 112 includes piezoelectric layers and internal electrodes alternately laminated one on another. The internal electrodes are lead out to end faces to form external electrodes. A flexible printed circuit (FPC) 115 as a flexible wiring board is connected to the external electrodes of the piezoelectric element 112A to apply a drive waveform to the piezoelectric element 112A.

The frame member 120 includes the common liquid chambers 110 to which liquid is supplied from the head tanks 42.

In the liquid discharge head 41, for example, when the voltage applied to the piezoelectric element 112A is lowered from an intermediate potential, the piezoelectric element 112A contracts. As a result, the vibration portion 130 of the diaphragm member 103 moves downward and the volume of the individual liquid chamber 106 increases, thus causing liquid to flow into the individual liquid chamber 106.

When the voltage applied to the piezoelectric element 112A is raised, the piezoelectric element 112A expands in the direction of lamination. The vibration portion 130 of the diaphragm member 103 deforms in a direction toward the nozzle 104 and contracts the volume of the individual liquid chamber 106. Thus, liquid in the individual liquid chamber 106 is pressurized and discharged (jetted) from the nozzle 104.

When the voltage applied to the piezoelectric element 112A is returned to the intermediate potential, the vibration portion 130 of the diaphragm member 103 is returned to the initial position. Accordingly, the individual liquid chamber 106 inflates, which generates a negative pressure. Thus, the liquid is supplied from the common liquid chamber 110 to the individual liquid chamber 106. After the vibration of a meniscus surface of the nozzle 104 decays to a stable state, the liquid discharge head 41 shifts to an operation for the next droplet discharge.

Figure 5:
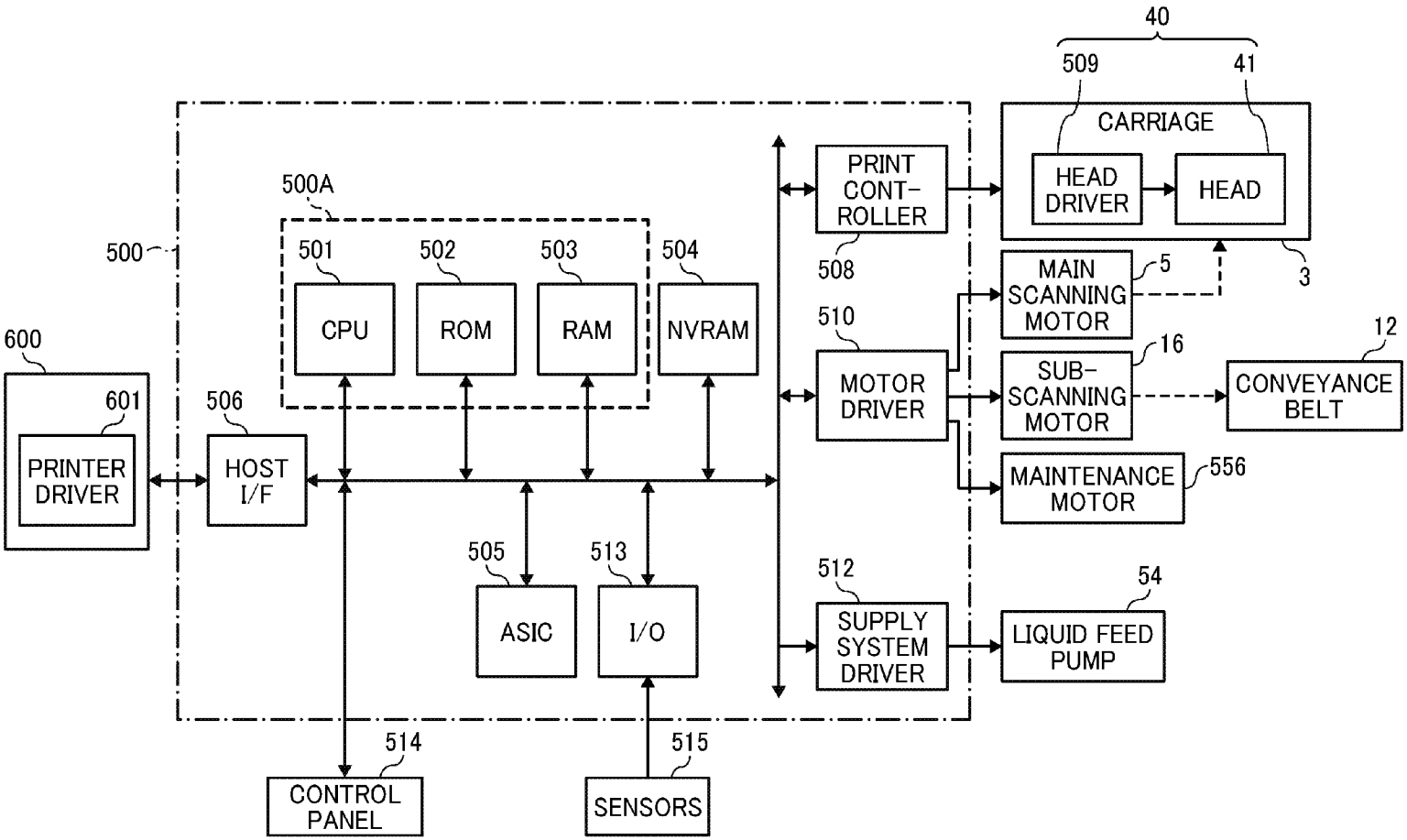
FIG. 5 is a block diagram of a controller of the liquid discharge apparatus according to an embodiment of the present disclosure.

Next, a controller of the liquid discharge apparatus is described with reference to FIG. 5. FIG. 5 is a block diagram of the controller of the liquid discharge apparatus according to an embodiment of the present disclosure.

In FIG. 5, a controller 500 according to the present embodiment includes a main controller 500A that includes a central processing unit (CPU) 501, a read-only memory (ROM) 502, and a random access memory (RAM) 503. The CPU 501 administrates the control of the entire liquid discharge apparatus 1000. The ROM 502 stores fixed data, such as various programs including programs executed by the CPU 501, and the RAM 503 temporarily stores image data and other data.

The controller 500 includes a rewritable nonvolatile random access memory (NVRAM) 504 to retain data during the apparatus is powered off. The controller 500 includes an application specific integrated circuit (ASIC) 505 to perform image processing, such as various signal processing and sorting, on image data and process input and output signals to control the entire liquid discharge apparatus 1000.

The controller 500 also includes a print controller 508 and a driver integrated circuit (hereinafter, head driver) 509. The print controller 508 includes a data transmitter to control driving of the liquid discharge head 41. The head driver 509 includes the drive waveform generating device according to an embodiment of the present disclosure to drive the liquid discharge head 41.

The controller 500 further includes a motor driver 510 to the main scanning motor 5, the sub-scanning motor 16, and a maintenance motor 556. The main scanning motor 5 moves the carriage 3 for scanning, and the sub-scanning motor 16 circulates the conveyance belt 12. The maintenance motor 556 moves the suction cap 21, the moisture-retention cap 22, and the wiper 23 of the maintenance device 20 and drives a suction device connected to the suction cap 21.

The controller 500 further includes a supply system driver 512 to drive the liquid feed pump 54 of the liquid feed pump unit 52.

The controller 500 includes an input-output (I/O) unit 513. The I/O unit 513 performs various sensor data and acquires data from various types of sensors 515 mounted in the liquid discharge apparatus 1000. The I/O unit 513 also extracts data for controlling the liquid discharge apparatus 1000, and uses extracted data to control the print controller 508 and the motor driver 510. The sensors 515 include, for example, an optical sensor to detect a position of the sheet material 10 and an interlock switch to detect the opening and closing of a cover.

The controller 500 is connected to a control panel 514 to input and display information necessary to the liquid discharge apparatus 1000.

Here, the controller 500 includes an interface (I/F) 506 to send and receive data and signals to and from a host 600, such as an information processing apparatus (e.g., a personal computer) or an image reader. The controller 500 receives such data and signals from the host 600 with the I/F 506 via a cable or network.

The CPU 501 of the controller 500 reads and analyzes print data stored in a reception buffer of the I/F 506, performs desired image processing, data sorting, or other processing with the ASIC 505, and transfers image data from the print controller 508 to the head driver 509. For example, a printer driver 601 of the host 600 or the controller 500 creates dot-pattern data for image output.

The print controller 508 transfers the image data as serial data and transfers to the head driver 509, for example, transfer clock signals and latch signals for the transfer of image data and determination of the transfer. The print controller 508 selects a plurality of types of drive waveform data stored and retained in the ROM 502 and outputs the selected drive waveform data as a standard drive waveform data to the head driver 509

Based on the image data corresponding to one line of the liquid discharge head 41 serially transferred from the print controller 508 and the drive waveform data transferred from the print controller 508, the head driver 509 generates and outputs a discharging drive waveform for each piezoelectric element 112A as the pressure generator of the liquid discharge head 41, to drive the liquid discharge head 41.

Figure 6:
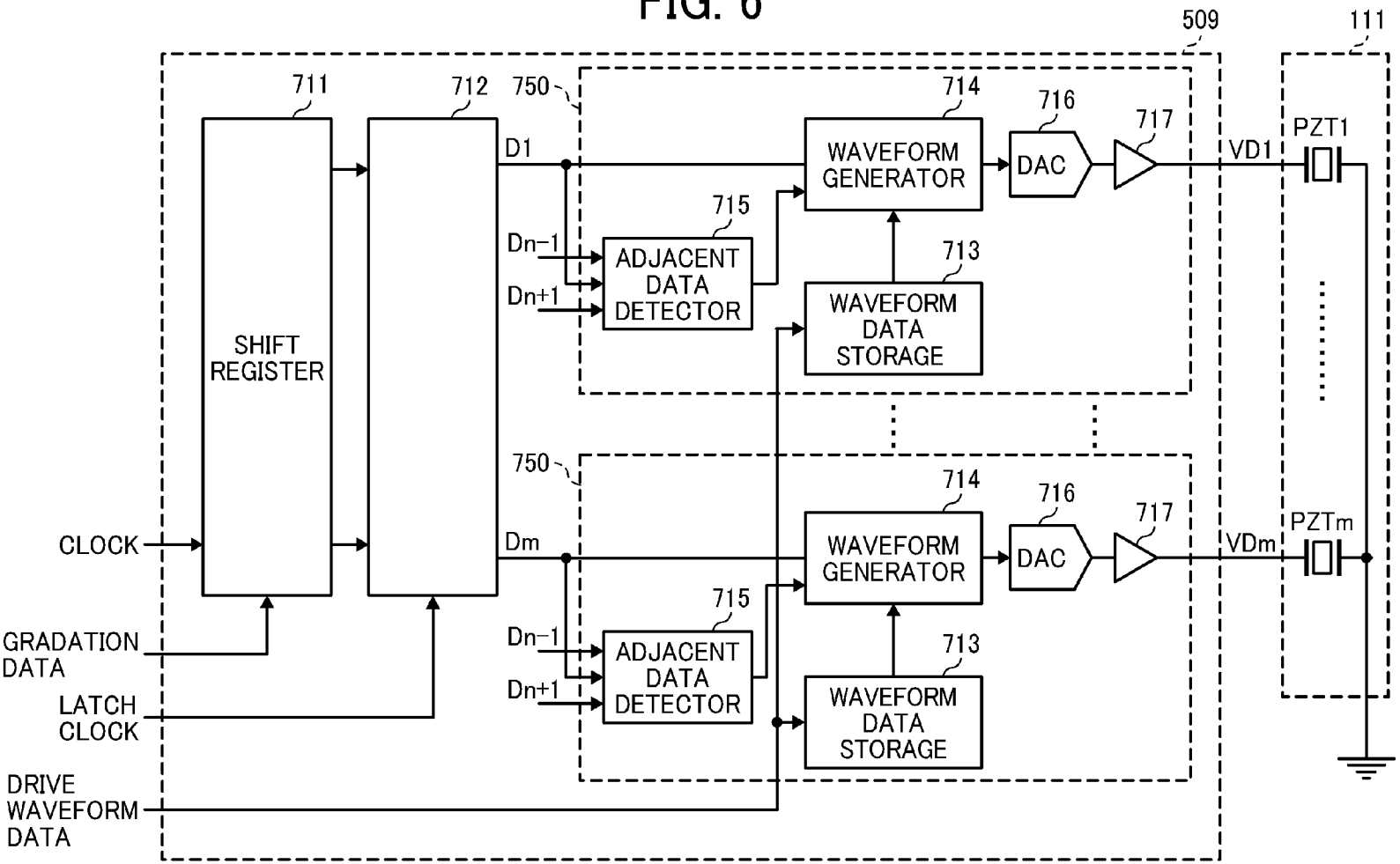
FIG. 6 is a block diagram of a head driver according to an embodiment of the present disclosure.

The head driver according to an embodiment of the present disclosure is described below with reference to FIG. 6.

The head driver 509 also acts as the drive waveform generating device according to an embodiment of the present disclosure. The head driver 509 includes a shift register 711, a latch circuit 712, a waveform data storage 713, a waveform generator 714, an adjacent data detector 715, a digital-to-analog (D/A) converter 716 (DAC in FIG. 6), and an amplifier 717.

Note that the waveform data storage 713, the waveform generator 714, the adjacent data detector 715, the D/A converter 716, and the amplifier 717 are provided for each of the piezoelectric elements 112A (hereinafter referred to as "PZTs") and constitute a drive waveform generating unit 750 to generate a drive waveform for each of the pressure generators corresponding to the respective nozzles 104 of the liquid discharge head 41.

The shift register 711 receives an input of a transfer clock (shift clock) signal and serial image data representing one nozzle row (gradation data: 2 bits per channel (nozzle)) from the print controller 508. The latch circuit 712 latches each resist value of the shift register 711 corresponding to a latch signal.

The waveform data storage 713 stores and retains the standard drive waveform data transferred from the print controller 508. The ROM 502 stores and retains a plurality of types of drive waveform data corresponding to ambient temperatures and other conditions. The drive waveform data corresponding to a detected ambient temperature and other predetermined conditions is read and transferred as the standard drive waveform data to the waveform data storage 713.

The adjacent data detector 715 receives inputs of gradation data Dn of a target nozzle and gradation data Dn−1 and Dn+1 of nozzles adjacent to the target nozzle. The adjacent data detector 715 then detects the presence or absence of liquid discharge from the adjacent nozzles and a type (type of droplet) representing the size of discharged droplet as information associated with a type of drive waveform to be applied to the pressure generator corresponding to each adjacent nozzle.

Note that the gradation data and the information relating to the droplet size have a one-to-one correspondence with each other. For example, gradation data 0 is no discharge, gradation data 1 is a small droplet, and gradation data 2 is a large droplet.

The waveform generator 714 reads from the waveform data storage 713 the standard drive waveform data corresponding to the gradation data Dn latched by the latch circuit 712. Then, data that represents a waveform shape of the standard drive waveform that is to be applied to the target nozzle and that is varied (corrected) in accordance with whether the adjacent nozzles discharge liquid and the droplet type detected by the adjacent data detector 715 is output as drive waveform data.

The drive waveform data from the waveform generator 714 is subject to D/A conversion by the D/A converter 716 and amplified as necessary by the amplifier 717 before being applied as a drive waveform VD to a corresponding piezoelectric element PZT.

Figure 7A:
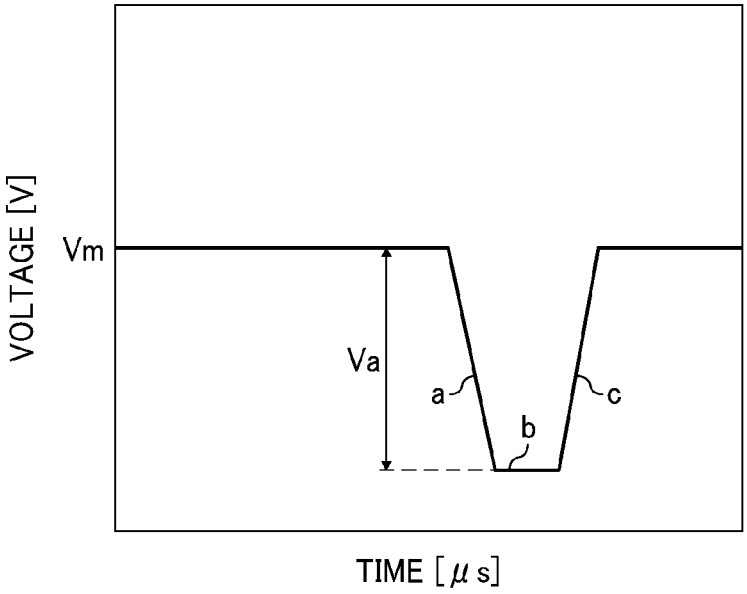
FIGS. 7A and 7B are diagrams of discharging drive waveforms generated by a drive waveform generating device according to an embodiment of the present disclosure.
Figure 7B:
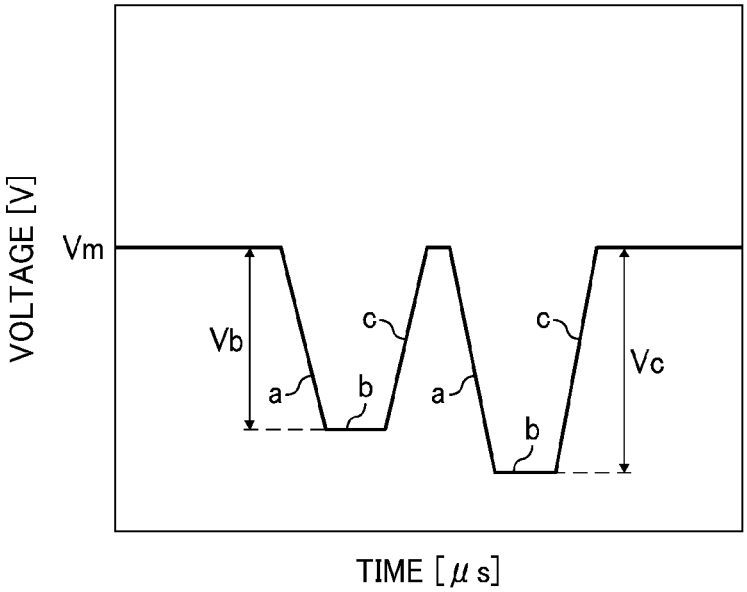

Drive waveforms generated by the drive waveform generating device according to an embodiment of the present disclosure are described below with reference to FIGS. 7A and 7B. FIGS. 7A and 7B are diagrams of the drive waveforms for a small droplet and a large droplet.

A drive waveform to discharge a small droplet (small droplet discharging drive waveform) illustrated in FIG. 7A is formed of a drive pulse P1. The drive pulse P1 includes an expansion waveform element (pulling waveform element) "a", a holding waveform element "b", and a contract waveform element (pushing waveform element) "c".

The expansion waveform element "a" of the drive pulse P1 falls from an intermediate potential Vm to inflate the individual liquid chamber 106. The holding waveform element "b" holds the falling potential by the expansion waveform element "a" for a predetermined period of time. The contract waveform element "c" rises from the potential held by the holding waveform element "b" (falling potential by the expansion waveform element "a") to the intermediate potential Vm to contract the individual liquid chamber 106 and to discharge the liquid. The drive pulse P1 has a voltage value (potential difference between the intermediate potential and the falling potential) of Va.

A drive waveform to discharge a large droplet (large droplet discharging drive waveform) illustrated in FIG. 7B is formed of drive pulses P2 and P3. The drive pulses P2 and P3 each include the expansion waveform element (pulling waveform element) "a", the holding waveform element "b", and the contract waveform element (pushing waveform element) "c".

The drive pulse P2 is a waveform having a voltage value Vb and the drive pulse P3 is a waveform having a voltage value Vc (Vb<Vc).

Droplets discharged by the drive pulses P2 and P3 merge to form a large droplet having a droplet amount greater than the small droplet has.

Figure 8:
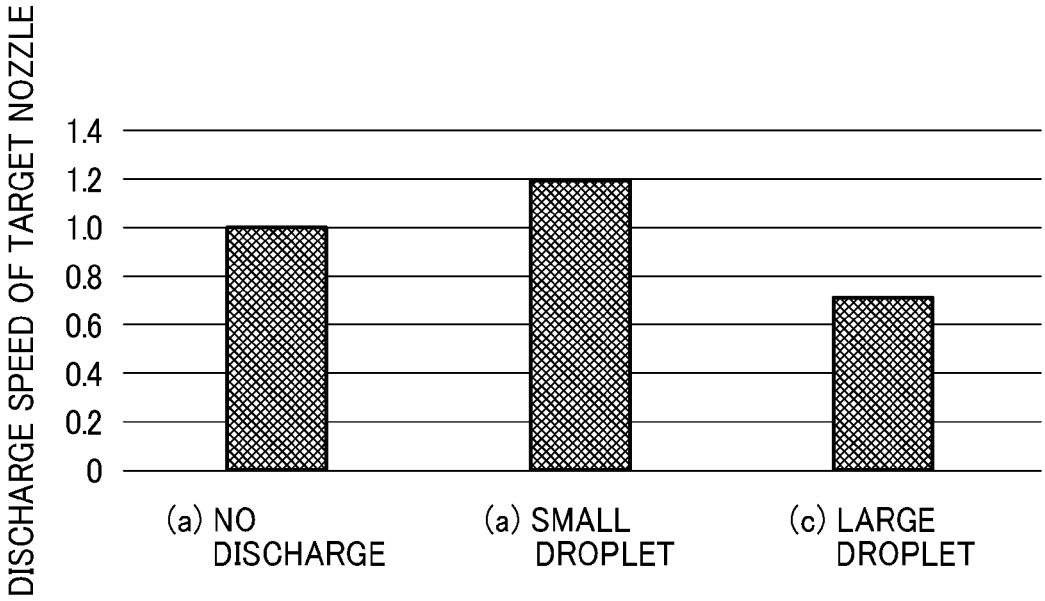
FIG. 8 is a chart of a relation between types of droplets discharged from a nozzle adjacent to a target nozzle and a discharge speed of the target nozzle, serving for illustrating adjacent crosstalk.
Figure 9A:
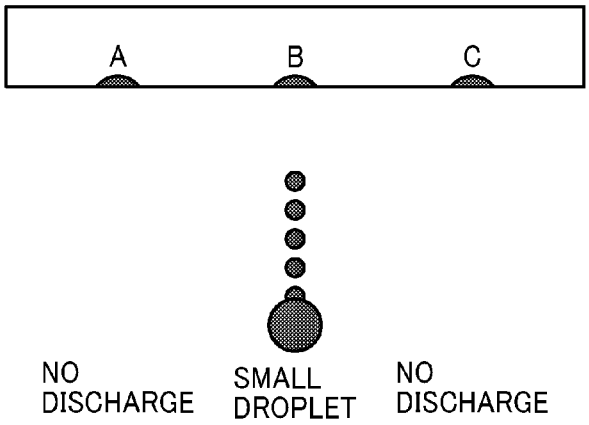
FIGS. 9A, 9B, and 9C are schematic illustrations of drive conditions in FIG. 8.
Figure 9B:
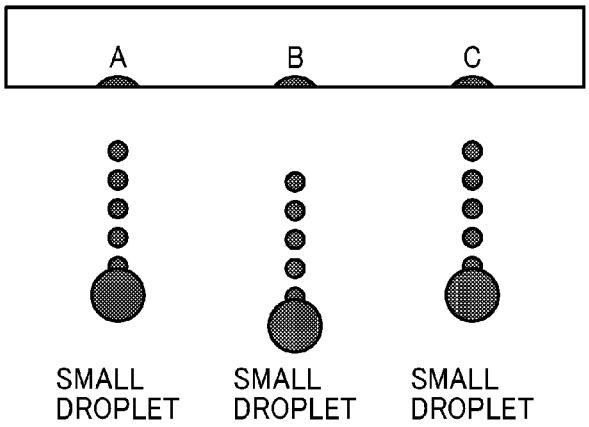
Figure 9C:
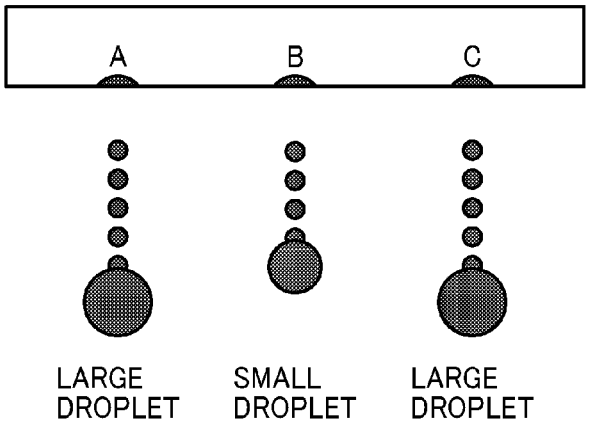

Adjacent crosstalk is described below with reference to FIGS. 8 and 9A to 9C. FIG. 8 is a chart illustrating a relation between types of droplets discharged from an adjacent nozzle adjacent to the target nozzle and a discharge speed of the target nozzle. FIGS. 9A, 9B, and 9C are schematic illustrations of drive conditions of FIG. 8.

Assume here that, as illustrated in FIGS. 9A to 9C, among nozzles A, B, and C, nozzle B represents the target nozzle and nozzles A and C represent the nozzles adjacent to the target nozzle B. Types of droplet to be discharged (droplet types) are the small droplet and the large droplet.

The discharge speed when the target nozzle B discharges a small droplet with the adjacent nozzles A and C in a no-discharge state as illustrated in FIG. 9A is assumed to be "1" (reference) as illustrated in (a) of FIG. 8.

It is here assumed that, as illustrated in FIG. 9B, the adjacent nozzles A and C also discharge small droplets when the target nozzle B discharges a small droplet. In this case, pressure propagates in a substantially identical phase through the partition 106A between the respective adjacent individual liquid chambers 106 of the nozzles A, B, and C, so that the discharge speed of the target nozzle B is greater than "1" (higher speed) as illustrated in (b) of FIG. 8.

In contrast, it is assumed that, as illustrated in FIG. 9C, the adjacent nozzles A and C discharge large droplets when the target nozzle B discharges the small droplet. In this case, because of different phases involved in change in pressure of the individual liquid chamber 106 of each of the nozzles A, B, and C, the discharge speed is smaller than "1" (lower speed) as illustrated, for example, in (c) of FIG. 8.

When crosstalk, in which the discharge speed of the droplet discharged from the target nozzle varies depending on the discharge conditions (whether the liquid is discharged and droplet type) of the nozzles adjacent to the target nozzle as described above, occurs, the landing position resultantly deviates, for example.

Thus, in one embodiment of the present disclosure, variations in the discharge speed are reduced through the change of the shape of the drive waveform to be applied to the pressure generator of the target nozzle in accordance with the discharge conditions of the nozzles adjacent to the target nozzle. An embodiment in which the shape of the drive waveform is changed using a correction value table is described below.

Generation of the drive waveform according to a first embodiment of the present disclosure is described with reference to FIG. 10. FIG. 10 is a table of correction values according to the first embodiment of the present disclosure.

In the first embodiment, the adjacent data detector 715 detects the discharge conditions of the adjacent nozzles that are disposed adjacent to the target nozzle.

The waveform generator 714 determines, using the correction value table as illustrated in FIG. 10, the correction value for the drive waveform that is to be applied to the pressure generator of the target nozzle and that corresponds to the discharge conditions of the nozzles adjacent to the target nozzle detected by the adjacent data detector 715, specifically in this case, a voltage adjustment value (%).

The waveform generator 714 outputs drive waveform data representing a voltage value of the standard drive waveform data (drive waveform data having a correction value of "0") that is stored and retained in the waveform data storage 713 and that is corrected (adjusted) to correspond to the voltage adjustment value.

The foregoing process generates drive waveform data having the waveform shape changed through the correction of the voltage values (the above-described peak values Va, Vb, and Vc) of the drive waveform and the generated drive waveform is applied to the pressure generator. In the present embodiment, the entire drive waveform is corrected with the correction value. However, in some embodiment, when a plurality of drive pulses are involved, voltage values of only one or two or more predetermined drive pulses may be corrected.

It is here noted that the correction value table illustrated in FIG. 10 represents the voltage adjustment values tabulated in advance for each of the droplet types discharged from the target nozzle when the correction value (adjustment value) is "0" with the adjacent nozzles on both sides of the target nozzle in a no-discharge state under different conditions of whether the adjacent nozzles discharge liquid and different discharged droplet types.

Such a correction value table is prepared through, for example, the following procedure.

For example, as in FIGS. 9A to 9C, assume that nozzle B represents the target nozzle and, among nozzles adjacent to the target nozzle B, nozzle A (left nozzle) and nozzle C (right nozzle) are the adjacent nozzles. Discharge states of the target nozzle B and the left and right nozzles A and C are combined with each other. In each of the different combinations of the discharge states, a change in the discharge speed of droplet for each droplet type of the target nozzle B is measured and a correction value that maintains a constant discharge speed is calculated and tabulated.

Next, examples of corrections of the discharging drive waveforms for the respective nozzles used in the correction value table of FIG. 10 is described with reference to FIG. 11.

In the example illustrated in FIG. 11, eight nozzles 104-1 to 104-8 constitute one nozzle row and nozzles 104-1 and 104-8 are nozzles on both extreme sides.

With respect to nozzle 104-1 assumed to be the target nozzle, the discharge droplet of nozzle 104-1 is a large droplet. Nozzle 104-1 has no left nozzle adjacent to nozzle 104-1 and nozzle 104-2 on the right of nozzle 104-1 has a small droplet. Thus, the correction value for the target nozzle 104-1 is "4". Specifically, the voltage value (peak value) of the large droplet discharging drive waveform retained in the waveform data storage 713 is corrected to be larger by "4%" and the resultant corrected large droplet discharging drive waveform is generated and output.

Similarly, with respect to nozzle 104-2 assumed to be the target nozzle, the target nozzle 104-2 has a small droplet, nozzle 104-1 on the left of nozzle 104-2 has a large droplet, and nozzle 104-3 on the right of nozzle 104-2 is in the no-discharge state. Thus, the correction value for the target nozzle 104-2 is "3". With respect to nozzle 104-5 assumed to be the target nozzle, the target nozzle 104-5 has a small droplet, nozzle 104-4 on the left of nozzle 104-5 is in the no-discharge state, and nozzle 104-6 on the right of nozzle 104-5 has a large droplet. Thus, the correction value for the target nozzle 104-5 is "3".

With respect to nozzle 104-6 assumed to be the target nozzle, the target nozzle 104-6 has a large droplet, nozzle 104-5 on the left of nozzle 104-6 has a small droplet, and nozzle 104-7 on the right of nozzle 104-6 has a large droplet. Thus, the correction value for the target nozzle 104-6 is "2". With respect to nozzle 104-7 assumed to be the target nozzle, the target nozzle 104-7 has a large droplet, nozzle 104-6 on the left of nozzle 104-7 has a large droplet, and nozzle 104-8 on the right of nozzle 104-7 has a small droplet. Thus, the correction value for the target nozzle 104-7 is "2". With respect to nozzle 104-8 assumed to be the target nozzle, the target nozzle 104-8 has a small droplet, nozzle 104-7 on the left of nozzle 104-8 has a large droplet, and the target nozzle 104-8 has no left nozzle adjacent to the target nozzle 104-8. Thus, the correction value for the target nozzle 104-8 is "3".

The foregoing correction procedure reduces variations in the discharge speed caused by crosstalk and in the landing position, thus achieving, for example, improved image quality.

Any combination of the discharge states may be used as reference for the voltage adjustment value when the correction is made through the adjustments of the voltage value of the discharging drive waveform as in the above embodiment. With the above-described example of the correction value table, however, the reference is established for a case in which both the left and tight nozzles are in the no-discharge state and the adjustment values with respect to the reference value are set as the correction values.

The correction value table may be prepared for each of all heads mounted in the liquid discharge apparatus. Alternatively, the correction value table may even be prepared for one or two or more representative heads and the correction values for the representative heads may be applied to all heads.

The correction of the discharging drive waveform is not required to be made for all combinations of the discharge states. The correction may be made only for a combination involving large variations in the speed of the target nozzle. The foregoing approach can simplify the correction process (process for changing the waveform shape).

In the present embodiment, the nozzles adjacent to the target nozzle are the nozzles immediately next to the target nozzle. However, in some embodiments, the adjacent nozzles may include nozzles second adjacent to the target nozzle. For example, the adjacent nozzles may include two nozzles each on the left and right of the target nozzle (a total of four nozzles). The foregoing approach enables an accurate correction of the discharge speed even in a head having a large effect of crosstalk.

In the present embodiment described above, the voltage value of the discharging drive waveform is corrected to change the waveform shape. The discharge speed may nonetheless be changed through a change of a relation with, for example, a pulse width and a pulse interval of the drive pulse, gradient of the waveform element, and a natural oscillation period Tc of the individual liquid chamber.

The present embodiment has been described for a case in which the discharge droplet types are small and large droplets and the discharge states are no discharge, small droplet discharge, and large droplet discharge. The described embodiment is illustrative only and not limiting. An arrangement may, for example, be made in which droplets of large, medium, and small, or more droplet types can be discharged. Additionally, the no-discharge state may include a case in which the drive waveform is not applied and a case in which a micro drive waveform (non-discharge drive waveform) that moves a meniscus such that the droplet is not discharged is applied.

The present embodiment has been described for a case in which the discharge speed is higher when the droplet types of the target nozzle and the adjacent nozzles are the same and the discharge speed is lower when the droplet types of the target nozzle and the adjacent nozzles are different from each other. Variations in the discharge speed are nonetheless variable among different head configurations. For example, depending on hardness of the partitions between the individual liquid chambers and a height of the individual liquid chambers, the discharge speed may be lower even when the droplet types of the target nozzle and the adjacent nozzles are the same and the discharge speed may be higher even when the droplet types of the target nozzle and the adjacent nozzles are different from each other. Thus, it is sufficient to change the drive waveform shape in accordance with variations in the discharge speed of the head.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a polymerizable compound, a resin, a functional material, such as a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

The liquid discharge apparatus may be, for example, an apparatus capable of discharging liquid to a material to which liquid can adhere and an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. The "printing apparatus" may be, for example, a serial-type apparatus to move a liquid discharge head relative to a sheet material or a line-type apparatus that does not move a liquid discharge head relative to a sheet material.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "molding" used herein may be used synonymously with each other.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A drive waveform generating device, comprising:

a plurality of waveform generating units, each of the plurality of waveform generating units being configured to generate and apply a droplet discharging drive waveform to a corresponding one of a plurality of pressure generators respectively provided corresponding to a plurality of nozzles of a liquid discharge head, each of the plurality of waveform generating units including:

a detector, configured to detect a type of droplet dischargable from at least one nozzle adjacent to a target nozzle, the type of droplet including a relatively small droplet or a relatively large droplet; and a waveform generator, configured to apply the droplet discharging drive waveform to be applied to one pressure generator, corresponding to the target nozzle, in accordance with the type of droplet detected by the detector, the droplet discharging drive waveform in accordance with the relatively small droplet including a single pulse and the droplet discharging drive waveform in accordance with the relatively large droplet including a plurality of pulses, and the droplet discharging drive waveform in accordance with the relatively small droplet being of a phase different from a phase the droplet discharging drive waveform in accordance with the relatively large droplet.

2. The drive waveform generating device according to claim 1, wherein the waveform generator is configured to correct a voltage value of one or more of the pulses to change a waveform shape of the droplet discharging drive waveform.

3. The drive waveform generating device according to claim 1, wherein the detector is configured to detect data associated with the type of the drive waveform to be applied to two pressure generators of the plurality of pressure generators corresponding to two nozzles adjacent to the target nozzle, wherein the waveform generator is configured to change a waveform shape of the droplet discharging drive waveform to be applied to the one pressure generator corresponding to the target nozzle in accordance with the data associated with the type of the drive waveform to be applied to the two pressure generators.

4. The drive waveform generating device according to claim 3, wherein the data associated with the type of the drive waveform includes data regarding the type of droplet dischargable from the at least one adjacent nozzle.

5. The drive waveform generating device according to claim 1, further comprising:

a correction value table to store a correction value for the droplet discharging drive waveform to be applied to the one pressure generator corresponding to the target nozzle, for each combination of a type of droplet dischargable from the target nozzle and a type of droplet dischargable from the at least one adjacent nozzle.

6. A liquid discharge device comprising:

the liquid discharge head; and the drive waveform generating device according to claim 1 to generate and output the drive waveform to discharge liquid from the liquid discharge head.

7. A liquid discharge apparatus comprising the liquid discharge device according to claim 6.

8. A liquid discharge apparatus comprising the drive waveform generating device according to claim 1.

9. The drive waveform generating device according to claim 1, wherein the type of droplet, including at least the relatively small droplet and the relatively large droplet, is detected by the detector based upon graduation data.

10. The drive waveform generating device according to claim 1, wherein pressure propagates in different phases through the plurality of pressure generators, respectively provided corresponding to the plurality of nozzles, upon the droplet discharging drive waveform applied to the target nozzle being the droplet discharging drive waveform in accordance with one of the relatively small droplet and the relatively large droplet and the droplet discharging drive waveform applied to the at least one nozzle adjacent to the target nozzle being the droplet discharging drive waveform in accordance with a different one of the relatively small droplet and the relatively large droplet.

11. The drive waveform generating device according to claim 1, wherein pressure propagates in a substantially identical phase through the plurality of pressure generators, respectively provided corresponding to the plurality of nozzles, upon the droplet discharging drive waveform applied to the target nozzle being the droplet discharging drive waveform in accordance with one of the relatively small droplet and the relatively large droplet and the droplet discharging drive waveform applied to the at least one nozzle adjacent to the target nozzle being the droplet discharging drive waveform in accordance with a same one of the relatively small droplet and the relatively large droplet.

12. A method for a drive waveform generating device including a plurality of waveform generating units, each of the plurality of waveform generating units being configured to generate and apply a droplet discharging drive waveform to a corresponding one of a plurality of pressure generators respectively provided corresponding to a plurality of nozzles of a liquid discharge head, and each of the plurality of waveform generating units including a detector and a waveform generator, the method comprising:

detecting a type of droplet discharged from at least one nozzle adjacent to a target nozzle, the type of droplet including a relatively small droplet or a relatively large droplet; and applying a droplet discharging drive waveform to one pressure generator, corresponding to the target nozzle, in accordance with the type of droplet detected by the detector, the droplet discharging drive waveform in accordance with the relatively small droplet including a single pulse and the droplet discharging drive waveform in accordance with the relatively large droplet including a plurality of pulses, and the droplet discharging drive waveform in accordance with the relatively small droplet being of a phase different from the droplet discharging drive waveform in accordance with the relatively large droplet.

13. The method according to claim 12, wherein the type of droplet, including at least the relatively small droplet and the relatively large droplet, is detected based upon graduation data.

14. The method according to claim 12, wherein pressure propagates in different phases through the plurality of pressure generators, respectively provided corresponding to the plurality of nozzles, upon the droplet discharging drive waveform applied to the target nozzle being the droplet discharging drive waveform in accordance with one of the relatively small droplet and the relatively large droplet and the droplet discharging drive waveform applied to the at least one nozzle adjacent to the target nozzle being the droplet discharging drive waveform in accordance with a different one of the relatively small droplet and the relatively large droplet.

15. The method according to claim 12, wherein pressure propagates in a substantially identical phase through the plurality of pressure generators, respectively provided corresponding to the plurality of nozzles, upon the droplet discharging drive waveform applied to the target nozzle being the droplet discharging drive waveform in accordance with one of the relatively small droplet and the relatively large droplet and the droplet discharging drive waveform applied to the at least one nozzle adjacent to the target nozzle being the droplet discharging drive waveform in accordance with a same one of the relatively small droplet and the relatively large droplet.

* * * * *